US010259478B1

(12) United States Patent
Gao et al.

(10) Patent No.: US 10,259,478 B1
(45) Date of Patent: Apr. 16, 2019

(54) VEHICLE-VEHICLE COMMUNICATION BASED URBAN TRAIN CONTROL SYSTEM

(71) Applicant: Traffic Control Technology Co., Ltd, Beijing (CN)

(72) Inventors: Chunhai Gao, Beijing (CN); Qiang Zhang, Beijing (CN); Junguo Sun, Beijing (CN)

(73) Assignee: Traffic Control Technology Co., Ltd., Beijing (CN)

( * ) Notice: Subject to any disclaimer, the term of this patent is extended or adjusted under 35 U.S.C. 154(b) by 11 days.

(21) Appl. No.: 15/823,105

(22) Filed: Nov. 27, 2017

(30) Foreign Application Priority Data

Oct. 17, 2017 (CN) ..... 2017 1 0963594

(51) Int. Cl.

| | |
|---|---|
| ***B61L 25/06*** | (2006.01) |
| ***B61L 23/00*** | (2006.01) |
| ***B61L 27/00*** | (2006.01) |
| ***B61L 23/34*** | (2006.01) |
| ***B61L 25/02*** | (2006.01) |
| ***B61L 3/08*** | (2006.01) |

(52) U.S. Cl.
CPC ..... *B61L 27/0038* (2013.01); *B61L 3/08* (2013.01); *B61L 23/34* (2013.01); *B61L 25/021* (2013.01); *B61L 2027/005* (2013.01)

(58) Field of Classification Search
USPC ..... 701/19
See application file for complete search history.

(56) References Cited

U.S. PATENT DOCUMENTS 8,154,227 B1 * 4/2012 Young ..... A63H 19/24 318/255
2008/0128563 A1 * 6/2008 Kumar ..... B61L 3/127 246/187 A (Continued)

FOREIGN PATENT DOCUMENTS

CN 101009679 A 8/2007

OTHER PUBLICATIONS

The extended European search report dated May 18, 2018 for European Application No. 17199414.8, 6 pages.

(Continued)

*Primary Examiner* — Yazan A Soofi
(74) *Attorney, Agent, or Firm* — Law Offices of Liaoteng Wang

(57) ABSTRACT

An urban rail transit train control system based on vehicle-vehicle communications, comprising an intelligent train supervision (ITS) system, a train manage center (TMC), a data communication system (DCS), and an intelligent vehicle on-board controller (IVOC) provided on each of trains, the ITS system. The TMC and the IVOC are communicatively coupled by the DCS, and IVOCs of the trains communicatively coupled by the DCS. IVOCs of all the trains report first train operation information to the ITS system and second train operation information to the TMC in accordance with a predetermined period. The TMC sends the received second train operation information to the ITS system. The ITS system determines a following train that needs a virtual coupling operation and a head train corresponding to the following train, and dispatch a virtual coupling operation instruction to the head train IVOC to perform a virtual coupling operation of trains.

20 Claims, 3 Drawing Sheets

(56) References Cited

U.S. PATENT DOCUMENTS

| | | | | |
|---|---|---|---|---|
| 2009/0187291 | A1* | 7/2009 | Daum | B61L 3/006 701/2 |
| 2010/0023190 | A1* | 1/2010 | Kumar | B61L 3/006 701/20 |
| 2015/0307119 | A1* | 10/2015 | Ghaly | B61L 27/0038 246/122 R |
| 2015/0344050 | A1* | 12/2015 | Yanai | B61L 21/04 246/3 |
| 2016/0200327 | A1* | 7/2016 | Liu | B61D 17/00 105/8.1 |

OTHER PUBLICATIONS

Naeem Ali:"How Does an Operator Recover a Failed CBTC Train—Part 1", Aug. 16, 2017, retrieved from the Internet, 6 pages.
Naeem Ali:"How Does an Operator Recover a Failed CBTC Train—Part 2", Sep. 3, 2017, retrieved from the Internet, 9 pages.

* cited by examiner

VEHICLE-VEHICLE COMMUNICATION BASED URBAN TRAIN CONTROL SYSTEM

This application is based on and claims priority to Chinese Patent Application No. 201710963594.X filed on Oct. 17, 2017, which is incorporated herein by reference in its entirety.

TECHNICAL FIELD

The present disclosure relates to the technical field of train operations, and in particular to an urban rail transit (URT) train control system based on vehicle-vehicle communications.

BACKGROUND ART

With the rapid progress of URT, URT lines are being built rapidly and networked. As the need for URT operation capacity increases, usage and equipment maintenance for the signal system also increase. It is desired to reduce the number of trackside equipment and minimize the operation interval while securing safety of trains.

In a conventional URT signal system, ground equipment serves as the core for operation of trains. There are numerous kinds of ground equipment. Operation of a train is controlled in a train-ground-train manner, where the train has to perform back and forth communications with the ground equipment, leading to a long turnaround period as well as a limited flexibility and intelligent level of the control. In view of the defects in the conventional URT signal system, Communication Based Train Control (CBTC) based on vehicle-vehicle communications has been developed, which greatly simplifies the ground equipment. CBTC, with an Intelligent Vehicle On-board Controller (IVOC) mounted on the train as its core, is based on direct communications among trains. The train autonomously calculates a train movement authority based on an operation plan, railway resources, and an operation status of its own, to ensure an autonomous and safe control of the train on the railway, resulting in an improved operation efficiency and reliability of the train.

Trains should be operated with high safety and high operation efficiency. If there is a faulty train on the main line, e.g. a train with a communication fault or in an instable operation, the faulty train needs to be timely transferred by returning to a station or being moved to a turnout. Conventionally a faulty train is mainly discovered and transferred manually, where a staff needs to monitor the information from the IVOC of the train and from trackside equipment to determine if the train is faulty, and then inform a rescue train to go to the corresponding zone to transfer the faulty train. In this manner, it is necessary to provide a dedicated rescue train and so that scheduling staff may transfer the faulty train using the rescue train. This may greatly affect the trains normally operated on the main line and result in a low operation efficiency.

In addition, in conventional operation and control schemes of trains, all the operating trains share the same operation and control rule. However in some special scenarios, for example during rush hours, there is a large number of passengers in one direction of the line while only a small number of passengers in the other direction. Using the same operation and control rule for the trains in both directions will lead to a low efficiency of train control and usage of communication resources for the direction in which there is only the small number of passengers.

SUMMARY

Embodiments of the disclosure provide a URT train control system based on vehicle-vehicle communications, which may improve an operation efficiency of trains.

According to a first aspect of the disclosure, an urban rail transit (URT) train control system based on vehicle-vehicle communications is provided, comprising an intelligent train supervision (ITS) system, a train manage center (TMC), a data communication system (DCS), and an intelligent vehicle on-board controller (IVOC) provided on each of trains, the ITS system, the TMC and the IVOC being communicatively coupled by the DCS, and IVOCs of the trains being communicatively coupled by the DCS.

The ITS system is configured to: supervise the trains that are on-line, dispatch an operation plan to the IVOCs, receive first train operation information reported by the trains in accordance with a predetermined period and second train operation information sent by the TMC in accordance with the predetermined period, determine a following train for which a virtual coupling operation is needed and a head train corresponding to the following train, and dispatch a virtual coupling operation instruction to the IVOC of the head train.

The virtual coupling operation means that the following train runs following the head train, the following train includes a faulty train and a train that meets a preset condition of virtual coupling operation, each of the first train operation information and the second train operation information comprises numbers, locations, and operation statuses of the trains, and the virtual coupling operation instruction comprises a zone in which the following train is located.

The TMC is configured to receive the second train operation information reported by the trains that are on-line in accordance with the predetermined period, and to send the second train operation information to the ITS system.

The IVOC is configured to: perform information interaction with the ITS system, the TMC, and the IVOCs of the others among the trains, report the first train operation information to the ITS system in accordance with the predetermined period, report the second train operation information to the TMC, and control, when a train is determined as the head train, the train to go to the zone in which the following train in the virtual coupling operation instruction is located, and establish communication with the IVOC of the following train to complete a virtual coupling for the virtual coupling operation.

In an embodiment, the train control system may further comprise an object controller (OC), the OC and the ITS system being communicatively coupled by the DCS, and the OC and the IVOC being communicatively coupled by the DCS, wherein the IVOC may further be configured to send, after the virtual coupling is completed between the head train and the vehicle train, virtual coupling complete information and newly marshalled train information to the ITS system, wherein the newly marshalled train information comprises the number of the head train, the number of the following train, and the length of the marshalled train; wherein the ITS system may be further configured to send to the OC, after receiving the virtual coupling complete information and newly marshalled train information, an object resource release instruction for the following train in the newly marshalled train information to cancel the number of the following train in the newly marshalled train information, wherein the object resource comprises a trackside equipment resource and a segment resource; and wherein the OC may be configured to release the object resource occupied by the corresponding following train according to the received object resource release instruction.

In an embodiment, the ITS system may be configured to determine, when the first train operation information or the second train operation information indicates existence of a train in a faulty operation status, the train in the faulty operation status as a faulty train; and the ITS system may be further configured to determine the zone in which the faulty train is located based on the first train operation information or the second train operation information.

In an embodiment, the ITS system may be configured to determine, when operation information of a train exists in neither of the first train operation information and the second train operation information, the train corresponding to the operation information as a faulty train; and wherein the ITS system may be further configured to determine the zone in which the faulty train is located based on the first train operation information reported by the faulty train last time and the second train operation information.

In an embodiment, the IVOC may be further configured to report, each time a train leaves a station, the number and the time of leave of the train to the ITS system; and wherein the ITS system may be further configured to receive the number and the time of leave of the train reported each time the train leaves a station, and to determine, if the number and the time of leave are not received from the train at a next station within a set period from the time of report at a current station, that the train, for which the number and the time of leave are not received at the next station, is located between the current station and the next station.

In an embodiment, the IVOC may be further configured to establish communication with the OC corresponding to a station region each time a train travels to the station region; and the OC may be further configured to report to the ITS system, when establishing communication with the train entering the station region is failed, that a faulty train is in the station region.

In an embodiment, the TMC may be further configured to identify a location-uncertain train based on the received second train operation information, to calculate the zone in which the location-uncertain train is located based on the second train operation information that the location-uncertain train reported last time, and to send to the ITS system the zone in which the location-uncertain train is located, wherein the location-uncertain train includes a train the second train operation information currently reported by which is abnormal; and the ITS system may be further configured to determine a fault train among location-uncertain trains based on the zone in which the locations uncertain trains are located and on the first train operation information.

In an embodiment, the train the second train operation information currently reported by which is abnormal may include: the train for which no reported second train operation information is received within a set period not shorter than the predetermined period; the train for which a jump occurs in its train speed; the train for which the reported current location information is the same as the location information reported last time; or the train that loses location degradation.

In an embodiment, the ITS system may be configured to determine, when no first train operation information for the location-uncertain train is received, the location-uncertain train as a fault train.

In an embodiment, the TMC may be configured to calculate the zone in which the location-uncertain train is located based on a possible running status of the location-uncertain train and the second train operation information the location-uncertain train reported last time, wherein the running status comprises continued running or emergency braking.

In an embodiment, if the running status is continued running, the TMC may be configured to: determine a forward farthest distance $s_{forward}$ of the location-uncertain train from a train location in the second train operation information $d_{location}$ reported last time, based on a maximum speed limit of the train $v_{maxspeed}$, a maximum traction acceleration of the train $a_{maxtraction}$, a train speed in the second train operation information reported last time $v_0$, and a time difference from reporting the second train operation information last time $t_{total}$; determine a reverse farthest distance $s_{reverse}$ of the location-uncertain train, based on $v_{maxspeed}$, an emergency braking acceleration of the train $a_{emergency}$, $v_0$ and $t_{total}$; and determine the zone in which the location-uncertain train is located based on $d_{location}$, $s_{forward}$, and $s_{reverse}$.

In an embodiment, the zone in which the location-uncertain train is located may be determined based on $d_{location}$, $s_{forward}$, and $s_{reverse}$ as: $[d_{location}-s_{reverse}-d_{safe}, d_{location}+s_{forward}+d_{safe}]$, $s_{forward}=v_{maxspeed}t_{total}-(v_{maxspeed}-v_0)^2/2a_{maxtraction}$, and $s_{reverse}=-v_{maxspeed}t_{total}+v_{maxspeed}^2/2a_{maxtraction}+v_0^2/2a_{emergency}+v_0v_{maxspeed}/a_{emergency}$, where $d_{safe}$ is a predetermined safe distance between trains.

In an embodiment, if the running status is emergency braking, the zone may be determined as: $[d_{location}-d_{maxrecede}-d_{safe}, d_{location}+s_{forwardtravel}+d_{safe}]$, $s_{forwardtravel}=v_0t_1+(1/2)a_{maxtraction}t_1^2+(v_0+a_{maxtraction}t_1)^2/a_3+\alpha(v_0+a_{maxtraction}t_1)+\beta$, where $d_{location}$ is the train location in the second train operation information that the location-uncertain train reported last time, $d_{maxrecede}$ is a predetermined tolerable maximum receding distance, $d_{safe}$ is a predetermined safe distance between trains, $s_{forwardtravel}$ is the sum of a distance the train travels during a predetermined period for communication fault determination and a distance the train travels after the emergency braking, $v_0$ is a train speed in the second train operation information that the location-uncertain train reported last time, $t_1$ is the period for communication fault determination, $a_{maxtraction}$ is a maximum traction acceleration of the train, $a_3$ is the sum of the emergency braking acceleration of the train and a slope-produced acceleration, $\alpha$ is a predetermined first coefficient, and $\beta$ is a predetermined second coefficient.

In an embodiment, if the following train is a train whose running status is emergency braking, the virtual coupling operation instruction may further comprise an exit path for virtual coupling operating train; and the IVOC may be further configured to operate according to the exit path after a successful virtual coupling of a train as the head train and a corresponding following train.

In an embodiment, the ITS system may be further configured to send the exit path to the TMC; and the TMC may be further configured to add the exit path to the zone in which the corresponding faulty train is located and send the zone after the addition to the ITS system and the IVOCs of the trains that are not faulty.

In an embodiment, the TMC may be further configured to, when the zone in which the location-uncertain train is located includes a railroad crossing, re-calculate the zone in which the location-uncertain train is located according to both statuses of the railroad crossing, and combine the zones calculated for the statuses as the zone in which the location-uncertain train is located.

In an embodiment, the TMC may be further configured to correct the zone in which the location-uncertain train is located based on at least one of location correction information and send to the ITS system the corrected zone in which the location-uncertain train is located; and wherein the location correction information may include: location information for the train immediately preceding the location-uncertain train, location information for the train immediately succeeding the location-uncertain train, location information for other trains that are on-line, trackside equipment status information reported by the OC, and line termination of the operation lines.

In an embodiment, the TMC may be further configured to obtain a train entrance information reported to the OC by an axle counter for main line entrance via communicative coupling between the DCS and the OC, obtain the zone in which the entering train is located according to the location of the axle counter for main line entrance that reports the train entrance information, and send to the ITS system the zone in which the entering train is located; and the ITS system may be further configured to determine an unscheduled train that has entered the main line for operation, based on the operation plan for the trains and the zone in which the entering train is located sent by the TMC, and determine the unscheduled train as a faulty train.

In an embodiment, the zone in which the entering train is located may be: $[d_{entrance}, d_{entrance}+v_{RMspeedlimit}t+d_{safe}]$, where $d_{entrance}$ is the location of the axle counter for main line entrance that reports the train entrance, $v_{RMspeedlimit}$ is the maximum speed limit of the train under a restricted manual-drive (RM) mode, t is the period so far from the entering train pressed on the axle counter for main line entrance, and $d_{safe}$ is a predetermined safe distance between trains.

In an embodiment, the IVOC may further include an active recognition unit configured to: obtain an image in front of the train, and recognize a front train according to the obtained image, wherein if the train is determined as the head train and unable to establish communication with the IVOC of the corresponding following train through the DCS system, then after the train arrives at the zone in which the corresponding following train is located and the following train is recognized, the active recognition unit is configured to establish communication with the active recognition unit of the recognized following train based on a preconfigured communication manner to complete the virtual coupling.

In an embodiment, the TMC may be further configured to correct the zone in which the following train is located, based on a front train recognition result from an active recognition unit of an on-line train other than the following train.

In an embodiment, when there is more than one location-uncertain trains on a same operation line, if the zones in which adjacent location-uncertain trains are located overlap, or if a distance between the zones in which adjacent location-uncertain trains are located is less than a predetermined distance, the TMC may be further configured to combine the zones in which the adjacent location-uncertain trains are located, use the combined zone as a zone in which the adjacent location-uncertain trains are located, and send the adjacent location-uncertain trains and the combined zone to the ITS system.

In an embodiment, the preset condition of virtual coupling operation may include trains among more than one adjacent trains other than the foremost train, the more than one adjacent trains meeting a predetermined condition in operation time and operation direction; and the ITS system may be configured to determine the foremost train as the head train corresponding to the following trains among the more than one adjacent trains.

In an embodiment, the ITS system may be configured to cancel, when a train is determined as a faulty train and then the first train operation information or the second train operation information is received indicating that the faulty train is in a normal operation status, the determination of the train as the faulty train and the corresponding virtual coupling operation instruction.

According to the URT train control system based on vehicle-vehicle communications in accordance with the embodiments of the disclosure, a new concept of virtual coupling operation is proposed. When there is a faulty train or a predetermined condition is met, the ITS system will dispatch a virtual coupling operation instruction to achieve following operation among trains. With the system, a normal train serves as a head train to lead a following train. When a fault occurs, it is not necessary to send a dedicated rescue train. A faulty train may be transferred rapidly, resulting in a decreased cost in construction and maintenance of the system and an improved efficiency and reliability of train operation. When the predetermined condition is met, virtual coupling operation is performed, which can reduce the cost of communication resources for the following train and improve the efficiency of train operation.

BRIEF DESCRIPTION OF THE DRAWINGS

Other features, objects and advantages of the disclosure will be apparent from the following detailed description when read with reference to the accompanying drawings in which like reference characters refer to like parts throughout.

DETAILED DESCRIPTION

Reference will now be made in detail to exemplary embodiments, examples of which are illustrated in the accompanying drawings. The implementations set forth in the following description of exemplary embodiments do not represent all implementations consistent with the disclosure. Instead, they are merely examples of apparatuses and methods consistent with aspects related to the disclosure as recited in the appended claims.

Figure 1:
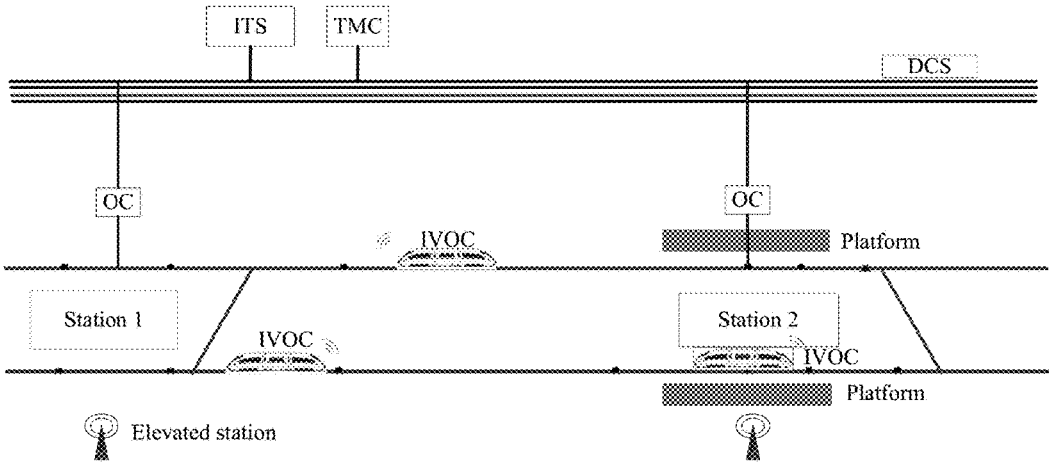
FIG. 1 is an architectural schematic of an URT train control system based on vehicle-vehicle communications according to an embodiment of the disclosure.

FIG. 1 is an architectural schematic of an urban rail transit (URT) train control system based on vehicle-vehicle communications according to an embodiment of the disclosure. As shown in the drawing, the train control system according to the embodiment may mainly include an intelligent train supervision (ITS) system, an object controller, a train manage center (TMC), a data communication system (DCS), and an intelligent vehicle on-board controller (IVOC) provided on each of trains. The ITS system, the TMC and the IVOC may be communicatively coupled by the DCS, and IVOCs of different trains may be communicatively coupled by the DCS to achieve vehicle-vehicle communications.

In the embodiment of the disclosure, the ITS system is configured to: supervise the trains that are on-line, dispatch an operation plan to the IVOCs, receive first train operation information reported by the trains in accordance with a predetermined period and second train operation information sent by the TMC in accordance with the predetermined period, determine a following train for which a virtual coupling operation is needed and a head train corresponding to the following train, and dispatch a virtual coupling operation instruction to the IVOC of the head train.

The virtual coupling operation as used herein may mean that a following train runs following a head train, or in other words, the head train leads the following train. The following train may be a faulty train or a train that meets a preset condition of virtual coupling operation. Each of the first train operation information and the second train operation information may include numbers, locations, and operation statuses of the trains, and the virtual coupling operation instruction may include a zone in which the following train is located.

The TMC may be configured to receive the second train operation information reported by the trains that are on-line, in accordance with the predetermined period, and configured to send the second train operation information to the ITS system.

The IVOC may be configured to perform information interaction with the ITS system, the TMC, and the IVOCs of the others among the trains, and to report the first train operation information to the ITS system in accordance with the predetermined period, report the second train operation information to the TMC. When a train is determined as the head train, the IVOC may control the train to go to the zone in which the following train in the virtual coupling operation instruction is located, and establish communication with the IVOC of the following train to complete a virtual coupling for the virtual coupling operation.

With the train control system of the embodiment, the IVOC of a train reports its operation status information to the TMC and ITS system respectively, and the TMC sends the received operation status information of trains to the ITS system. ITS system can determine the following train for which a virtual coupling operation is needed based on the operation information reported by the train and the operation information of trains sent by the TMC. After determining the following train and the head train corresponding to the following train, the virtual coupling operation instruction can be dispatched to the IVOC of the head train so that the head train may travel to the zone in which the following train is located and may lead the following train for the virtual coupling operation. When the head train receives the virtual coupling operation instruction dispatched by the ITS system, it may follow the instruction to go to the zone in which the following train is located to perform the virtual coupling. When the head train gets to a certain distance (e.g. 100 meters, which may be configurable) from the zone in which the following train is located, the head train travels into the zone at a low speed. In case of the following train has a normal vehicle-vehicle communications function which enables the IVOCs of the head train and the following train to establish communication through the DCS, communication is established between the head train and the following train to complete the virtual coupling.

For the purpose of convenient description, in the embodiment the train that functions as the leader in virtual coupling operation is referred to as head train, while the train for which the virtual coupling operation is needed is referred to as following train. In virtual coupling operation, a head train may lead at least one following train, and in other words, there may be a plurality of following trains.

For the train control system in accordance with the embodiment, the following train may be a faulty train or a train that meets the preset condition of virtual coupling operation. If the following train is a faulty train, as it is not necessary to send a dedicated rescue train and the head train may lead the faulty train to travel, the faulty train may be rapidly transferred, and efficiency and reliability of train operation may be improved. If the following train is a train that meets the above mentioned preset condition of virtual coupling operation, the following train under the virtual coupling operation does not need to communicate in real time with the ITS system and the TMC, the cost of communication resources for the following train to communicate with other equipment of the system can be reduced and the efficiency of train operation can be improved.

In the embodiment, when the following train is a faulty train, the ITS system will designate a head train corresponding to the following train. In practice, ITS system may select a train near the faulty train as the head train to perform the virtual coupling for rescue.

In an embodiment, the preset condition of virtual coupling operation may include trains among more than one adjacent trains other than the foremost train, with the more than one adjacent trains meeting a predetermined condition in terms of operation time and operation direction. In this case, the ITS system may be configured to determine the foremost train as the head train corresponding to the following trains among the more than one adjacent trains. That is, among more than one adjacent trains with operation time and operation direction meeting the predetermined condition, the foremost train in the more than one adjacent trains will function as the head train and the other trains as following trains, so that the head train leads the following trains to perform the virtual coupling operation.

In an embodiment of the disclosure, the predetermined condition may include that the operation time is rush hours and the operation direction is a preset direction. In practice, at rush hours (e.g. 7 am to 9 am or 5 pm to 7 pm), there is a large number of passengers in one direction of the line and a relatively small number of passengers in the other direction. At this time, the direction in which the number of passengers is small can be taken as the preset direction so that more than one adjacent trains perform a virtual coupling operation when traveling in this preset direction.

In an embodiment, the IVOC may further include an active recognition unit. The active recognition unit may be configured to obtain an image in front of the train, and to recognize a front train in front of the train according to the obtained image. If the train is determined as the head train and unable to establish communication with the IVOC of the corresponding following train through the DCS system, then after the train arrives at the zone in which the corresponding following train is located and recognizes the following train, the active recognition unit establishes communication with the active recognition unit of the recognized following train based on a preconfigured communication manner to complete the virtual coupling.

The train control system of the embodiment is provided with the active recognition unit. In case of a fault of communication function occurs in the following train, then after the head train arrives at the zone in which the following train is located and recognizes the following train through the active recognition unit, it is possible to establish communication based on the active recognition units of the two trains. In other words, in case that the head train and the following train to be coupled cannot communicate based on vehicle-vehicle communications, virtual coupling can be performed with active recognition as a backup solution.

In an embodiment, the active recognition unit may include, among others, an image capture module to capture the image in front of the train, an image recognition module to recognize if a train exists in the image based on the image and a predetermined image recognition algorithm, a display module (e.g. LED display) to display a result of recognition and to display information interacted with other trains based on the active recognition units, and a communication module to communicate with the other trains within a communication range based on a predetermined communication manner. The image capture module may be implemented with a camera (e.g. binocular high-definition camera) and/or ladar. Recognition of the front train may be achieved by the image capture module and the image recognition module. The head train may, after recognizing the following train based on the active recognition unit, establishes communication through the communication module with the communication module of the active recognition unit of the following train and displays information of the interaction between them through the display module, to complete the virtual coupling. The specific implementation of the communication module may be selected based on practical needs and may be, for example, a data transceiver.

In an embodiment, the head train may complete the virtual coupling with the corresponding following train in accordance with the virtual coupling operation instruction by: receiving the virtual coupling operation instruction from the ITS system, obtaining the number and zone of the following train based on the instruction, arriving at the zone of the following train, establishing communication with the following train based on vehicle-vehicle communications (communication between the IVOCs of the trains through the DCS) or on the active recognition unit (in the predetermined communication manner between the active recognition units), and transmitting shake-hands information between the head train and the following train in accordance with a preconfigured communication protocol to complete the virtual coupling. In completing the shake-hands, the following train may send the basic information (e.g. number, model, length, etc.) of the train to the head train, so that the head train can confirm the information of the following train to complete the shake-hands and the following train follows the head train to run.

Figure 2:
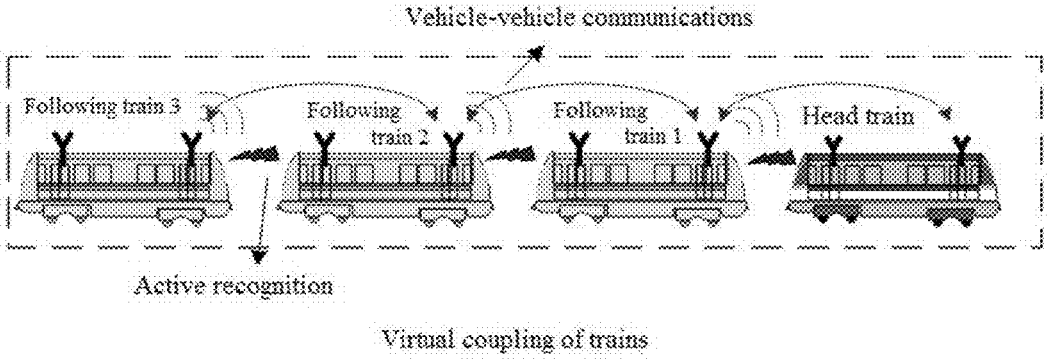
FIG. 2 shows an illustrative scene of virtual coupling operation according to an embodiment of the disclosure.

FIG. 2 shows an illustrative scene of virtual coupling operation according to an embodiment of the disclosure. As shown in the drawing, there are three following trains in this embodiment. For this case, in the virtual coupling operation instruction, the zone in which the following train is located corresponds to the whole area of the 3 following trains. When the head train travels to the zone in which the following train is located, it may establish communication with the 3 following trains respectively through vehicle-vehicle communications or based on the active recognition units. After the confirmation on the basic information of the following trains, the virtual coupling with the 3 following trains is completed and the 3 following trains follow the head train to run.

Those skilled in the art will appreciate that the train control system in accordance with the embodiment of the disclosure may include other components in addition to the ITS system, the TMC, the DCS and the IVOCs. As shown in FIG. 1, an object controller (OC) and trackside equipment may be included. OC may be communicatively coupled with the ITS system by the DCS, and the OC and the IVOC may be communicatively coupled by the DCS. The trackside equipment may include railway crossings, axle counters, platform screen doors (PSDs), flood gates, and emergency stop push-buttons (EMPs). The trackside equipment and segment may be collectively referred to as objects. The OC may obtain object information, i.e. trackside equipment information and segment information, and send the object information to the ITS system and the IVOCs to support a safety operation and control of the trains, and may control the trackside equipment according to the trackside equipment control information dispatched by the IVOCs and the ITS system.

In an embodiment of the disclosure, the DCS is a distributed control system for the train control system. The DCS may include both a wired network for transmission of communication information for ground equipment (e.g. between the trackside equipment and the OC), and a wireless network for vehicle-vehicle communications and vehicle-ground communication information transmission.

In an embodiment, the DCS wireless network is designed according to such a principle that underground stations are based on free-wave communications while elevated stations are based on waveguide communications, so that a seamless switching may be ensured between underground stations, between elevated stations, and between underground and elevated stations. For outdoor free-wave wireless equipment and waveguide equipment, after access points (APs) are arranged in accordance with a test result of field strength, optical cables for each AP may be connected to a corresponding equipment center station, and power cables may be connected nearby to an equipment center station or non-equipment center station. Wireless free-wave and waveguide network equipment may be provided at a train head and a train tail, including an antenna for wireless receipt and an antenna for waveguide receipt. The wireless network equipment at the head and tail may belong to two independent wireless networks separately so that even if a fault occurs in either of the networks, the system can still operate normally.

As is shown in FIG. 1, the train control system may be divided into three layers: a center layer, a trackside layer, and an on-board layer, depending on logical functions and the locations of arrangement.

The center layer may include the ITS system and the TMC. It is possible to provide a single ITS system and a single TMC. The ITS system communicates with the TMC, the DCS and the IVOCs of all the trains, performs supervision, control and maintenance on the train working, vehicles, electromechanical equipment and power equipment, and performs emergency handling (e.g. by scheduling the trains to perform a virtual coupling operation so that a head train rescues a faulty train or leads trains that meet the condition of virtual coupling operation) in case of accidents. The ITS system also dispatches the operation plan to on-board equipment (i.e. IVOC), and receives train status information reported by the IVOC of each of the trains (i.e. the first train operation information). The ITS system also generates and sends to the IVOCs train operation control information based on the trackside information, the segment information and the train status information, and obtains speed limit information for the lines and sends it to the TMC.

The TMC manages line data and configuration data, and has such functions as dispatching a temporary speed limit.

The TMC receives the second train operation information reported by each of the trains and sends the second train operation information to the ITS system. The TMC may have the following specific functions.

(1) the TMC may serve as a centralized data source to store electronic map for operation lines, system configuration data, protocol configuration data, IP configuration table for equipment, and dynamic data of temporary speed limit, and to verify the data with the trains on-line and in real time.

(2) The TMC may perform bi-directional communication with the ITS system through DCS backbone networks to obtain the ITS system's adjustment on the operation speed limit and upload to the ITS system the temporary speed limit that has been set/canceled to inform scheduling staff of the speed limit information currently valid in the system.

(3) The TMC may perform bi-directional communication with all the on-line trains through DCS backbone networks to receive location information of the trains and send to the ITS system for display on a display interface of the ITS system.

(4) The TMC may perform bi-directional communication with all the on-line trains through DCS backbone networks to receive requests from the trains to update the trains of the temporary speed limit information for travelling control of the trains.

The trackside layer does not have signaling equipment. An object controller (OC) is provided at each station. OC is the core of ground equipment in the train control system and implements collection and control of status of trackside objects (including railroad crossing, PSD, EMP, etc.). OC performs bi-directional communication with the IVOC of a train and with the ITS system through wireless communication or DCS backbone networks, to provide the IVOC and the ITS system with the collected trackside object status, receive and respond to trackside object resource control commands from the IVOC and the ITS system, assign permissions to the trackside objects within its control, and control the trackside objects (e.g. railroad crossing, PSD) based on the commands and the assignment of permissions.

Compared with conventional CBTC systems, the train control system of the embodiment may greatly reduce ground equipment and trackside equipment, e.g. zone controller (ZC), computer interlocking (CI), signal machine, active responder, among others. It is possible to only provide an OC at each station to control such devices as railroad crossing, PSD and EMP.

The on-board layer mainly includes the IVOCs of trains. As the core of vehicle-vehicle communications, an IVOC may implement speed measurement of the train through a device such as radar or speed sensor, autonomous positioning of the train through satellite, ground responder, speed integral, etc., integrity self-check through continuous lines, and bi-directional communication between trains, or between the train and the ground in real time through wireless communication. Further, it may obtain such information as the location and driving mode of a front train by communicating with the front train, receive status information of e.g. railroad crossing, PSD, EMP, through vehicle-ground communication, calculate a movement authority (MA)/allowed operation speed and brake intervention curve for the train itself, and output a traction or braking to control the train's movement, in order to implement a moving block operation control to ensure a safe operation of the train. In addition, if a passive responder is arrange trackside, the train when traveling by the responder may receive a responder message induced by the responder to implement such functions as initial positioning and location correction of the train.

In an embodiment, the IVOC may include an intelligent train protection (ITP) subsystem for safety of the train. The ITP subsystem may obtain and send operation information of the train to the ITS system, generate a traveling path based on the trackside equipment information and segment information, and perform traveling control based on the traveling path. The IVOC may include an intelligent train operation (ITO) subsystem for achieving automatic traveling of the train to enable a driverless driving of the train on an automatic driving line under control of the ITP subsystem. The IVOC may include speed sensors to achieve speed measurement and/or range measurement of the train. For example, the train may be provided with two speed sensors at each end respectively. The IVOC may also include a Doppler radar speed sensor to achieve correction on the speed measurement. The IVOC may be provided with a balise transmission module (BTM) at each end to receive the responder message from the ground responder. The IVOC may be provided with a man-machine interface (MMI) module, which may include an MMI display, in the driver cab at each end of the train to provide prompt and warning to the driver. The IVOC may include a wireless communication module and antennas for vehicle-vehicle communication and vehicle-ground communication. For example, a vehicle-ground communication antenna may be provided at each end of the train. The IVOC may include other auxiliary equipment and components, for example structural elements equipped with MMI and buttons.

When a train is traveling on-line, the IVOC of the train may communicate with an OC within a zone in front of the train to obtain the information in the OC, e.g. list of IVOCs, list of axle counters and list of railroad crossings. The IVOC may query an electronic map of lines based on the number of the next stop zone in the operation plan and perform a path planning based on the obtained list of IVOCs, logical segment status in the list of axle counters, and the list of railroad crossings.

The list of IVOCs is a list storing ID information of all the trains that are in communication with the OC. The IVOC of a train obtains the train IDs of all the trains that are currently in communication with the OC from the list of IVOCs, and sends communication request information to the IVOCs of the trains corresponding to the train IDs. The IVOCs of the trains receive the communication request information, and establish communication with the above train to send their respective current locations. The IVOC of the train sorts the trains based on the logical segments corresponding to the current locations of those trains, matches the first occupied zone in front of the train and the sorted result of the trains to identify an immediately preceding train, and calculates a safe location of the train based on the location of the immediately preceding train. The IVOC of the train identifies the target railroad crossings based on the result of path planning, and determines if the target railroad crossings need to be switched based on the current status of the target railroad crossings. If a railroad crossing need to be switched, information of applying for an exclusive lock of the railroad crossing is sent to the OC. If the railroad crossing is free, the OC will send information of success in applying for the exclusive lock of the railroad crossing to the IVOC. The IVOC of the train may then autonomously calculate the MA for the train based on lock result of the railroad crossings, logical segment status, location of tail of the preceding train, current location of the ego train, speed limit in the segment, and slope information of the line, etc.

In an embodiment, the IVOC may send virtual coupling complete information and newly marshalled train information to the ITS system after the virtual coupling is completed between the head train and the vehicle train. The newly marshalled train information may include the number of the head train, the number of the following train, and the length of the marshalled train. After receiving the virtual coupling complete information and newly marshalled train information, the ITS system may send to the OC an object resource release instruction for the following train in the newly marshalled train information to cancel the number of the following train in the newly marshalled train information. The OC may release the object resource occupied by the corresponding following train according to the received object resource release instruction.

After communication is established between the head train and the following train based on vehicle-vehicle communications or active recognition units and the virtual coupling is completed, the IVOC of the head train may report the information of virtual coupling complete to the ITS system. The ITS system may cancel the number of the following train and dispatch to the OC the object resource release instruction for the corresponding following train. The OC may release the object resource that is controlled (i.e. occupied by application) by the following train so that other trains may apply for use of the corresponding object resource and the usage of system resources may be improved. In a train control system, in order to ensure safety in operation of trains, if communication between an OC and a train is interrupted with the object resource having not been released yet, the object resource that the train has applied for cannot be released, unless the communication is recovered or the train is successfully in virtual coupling.

In an embodiment, when the first train operation information or the second train operation information indicates existence of a train in a faulty operation status, the ITS system may determine the train in the faulty operation status as a faulty train. The ITS system may determine the zone in which the faulty train is located, based on the first train operation information or the second train operation information.

IVOC of a train will report the operation information of the train, including the status of the train, to the ITS system and the TMC in accordance with the predetermined period. When the train is in a faulty operation status, the IVOC of the train may actively report to the ITS system or the TMC that a fault occurs in the train and rescue is requested. Therefore, the ITS system may identify a faulty train based on the first train operation information reported by the IVOC and the second train operation information sent by the TMC, and determine the zone in which the faulty train is located based on the train operation information reported by the faulty train. After determining the faulty train and its zone, the ITS system may designate a head train which is in a near location to the faulty train to perform virtual coupling with the faulty train, and the head train may follow the instruction of the ITS system to bring the faulty train to a turnout or back to a station.

In an embodiment, when operation information of a train exists in neither of the first train operation information and the second train operation information, the ITS system may determine, as a faulty train, the train corresponding to the operation information that exists in neither of the first train operation information and the second train operation information. In this case, the ITS system may further determine the zone in which the faulty train is located based on the first train operation information reported by the faulty train last time and the second train operation information.

If neither the ITS system nor the TMC receives the operation information reported by a train, there will be a high likelihood that a fault occurs in the train. The ITS system may determine the corresponding train as a faulty train and determine the zone in which the faulty train is located based on the first train operation information reported by the faulty train last time and the second train operation information.

In an embodiment, each time a train leaves a station, the IVOC may report the number and the time of leave of the train to the ITS system. The ITS system may receive the number and the time of leave of the train reported each time the train leaves a station, and if the number and the time of leave are not received from the train at a next station within a set period from the time of report at a current station, the ITS system may determine that the train, for which the number and the time of leave are not received at the next station, is located between the current station and the next station.

In a train control system, when a train travels into a station region (each station has a predefined station region), the IVOC of the train needs to communicate with the ITS system to receive information such as operation plan and temporary speed limit. Typically a temporary speed limit is dispatched by the ITS system to the on-board equipment only when the train communicates with the ITS system and a previous operation task has been finished. The IVOC of a train may receive information dispatched by the ITS system or send information to the ITS system through multi-hop communication on emergency (faulty train, temporary speed limit dispatched, etc.) The ITS system is to record the number and the time of leave of a train leaving each station, and if no communication is established at the next station between the train and the ITS system within the specified time, it is determined that there is a faulty train between the two stations. If the ITS system is informed of or determines the zone in which the faulty train is located, it is possible to specify a normal train to perform the virtual coupling for rescue automatically or by scheduling staff manually.

In practice, if normal communication cannot be established between the IVOC and the ITS system within a station region, the train may travel to the next station in accordance with the original plan. This is because the ITS system dispatches operation plans taking redundancy into account and dispatches an operation plan for two stations each time.

In an embodiment, each time a train travels to a station region, the IVOC may establish communication with the OC corresponding to the station region. When establishing communication with the train entering the station region is failed, the OC may report to the ITS system that a faulty train is in the station region.

That is, the ITS system may determine, based on the information reported by the OC, the faulty train whose zone is in the station region corresponding to the OC. When a train travels to a station region, the IVOC of the train needs to establish communication with the OC to send object control commands to the OC. If in the station region, normal communication cannot be established between the IVOC and the OC, the train is not allowed to go on travelling until the communication is recovered, a virtual coupling is successful, or manual intervention is introduced.

In an embodiment, the TMC may further identify a location-uncertain train based on the received second train operation information, calculate the zone in which the location-uncertain train is located based on the second train operation information that the location-uncertain train reported last time, and send to the ITS system the zone in which the location-uncertain train is located. The location-uncertain train may include a train, the second train operation information currently reported by which is abnormal. The ITS system may determine a fault train among location-uncertain trains, based on the zone in which the locations uncertain trains are located and on the first train operation information.

If the TMC receives abnormal second train operation information reported by a train (a location-uncertain train) and the ITS system does not receive the first train operation information for the corresponding train, there is a high likelihood that a fault occurs in the train, and the ITS system determines the corresponding train as a faulty train.

When the TMC receives abnormal second train operation information, the train corresponding to the abnormal second train operation information is identified as a location-uncertain train. The TMC calculates the zone in which the location-uncertain train is located based on the second train operation information that the location-uncertain train reported last time (as the valid operation information received last time is normal operation information), and sends to the ITS system the calculated zone in which the location-uncertain train is located. The ITS system can identify a faulty train in location-uncertain trains, based on the zone in which the location-uncertain train is located that the TMC sent and the first train operation information for the location-uncertain train.

In an embodiment, the train the second train operation information currently reported by which is abnormal may include: the train for which no reported second train operation information is received within a set period; the train for which a jump occurs in its train speed; the train for which the reported current location information is the same as the location information reported last time; or the train that loses location degradation. The set period is not shorter than the predetermined period, and may be configured as an integer multiple of the predetermined period. In practice, other types of location-uncertain trains may also be set; in other words, the location-uncertain trains may be determined through predetermined screening conditions.

In the embodiment of the disclosure, location-uncertain train refers to such a train that does not report its valid location to the TMC, and may be the above mentioned train the train operation information currently reported by which is abnormal or a train that is not operating as planned. Situations for location-uncertain trains may be classified as: (1) a communication fault occurs between the train and the TMC (i.e. no reported second train operation information for the train is received within a set period); (2) the train reports its location which is invalid (i.e. a jump occurs in the train speed, or the train reports current location information which is the same as the location information it reported last time); and (3) the train reports that it loses location degradation (i.e. loss of location degradation occurs for the train).

In practice, different measures may be taken for the different situations above. For example, the location-uncertain train may continue its running (including going forward with a continued running or backward with an emergency braking), and the possible zone in which the train may be located may be calculated based on the maximum speed (the maximum speed limit as permitted) of the train. Alternatively, the location-uncertain train may apply an emergency braking, and the possible zone in which the train may be located may be calculated based on the emergency braking. The measures are configurable, and the IVOC on-board and the TMC may handle corresponding situations in accordance with the configurations.

In normal cases the TMC communicates with all the trains to obtain in real time the locations of the trains and report the locations of the trains to the ITS system. When the TMC cannot obtain the location information of a train or the train cannot report its own valid location to the TMC, the TMC treats this train as a location-uncertain train, calculates a possible zone in which the train may be located based on data of lines, performance data of the train, and the valid status data the train reported last time (valid operation information), and sends the possible zone to the ITS system and the other trains on-line.

In an embodiment, for the three types of location-uncertain trains, the TMC may calculate the locations for the location-uncertain trains in the following three manners.

If the TMC does not receive valid operation information reported by an on-line train within the preset period (e.g. five times the predetermined period), it is determined that a communication faults has occurred with the train, and the status of the train is changed to location-uncertain train. Based on the received valid operation information that the train reported last time and the trackside object status information for the zone of the train, the possible zone in which the location-uncertain train may be located may be determined per the configurations as if the train run at its maximum speed or applied an emergency braking.

If the TMC determines that an on-line train has reported an invalid location, the status of the train is changed to location-uncertain train. Based on the received valid operation information last time and the trackside object status information for the zone of the train, the TMC calculates the possible zone in which the location-uncertain train may be located, per the configurations as if the train run at its maximum speed or applied an emergency braking.

If the TMC receives information of an on-line train losing location degradation, the status of the train is changed to location-uncertain train. Based on the received valid operation information last time and the trackside object status information for the zone of the train, the possible zone in which the location-uncertain train may be located may be calculated as if the train applied an emergency braking. TMC can obtain the IDs, statuses (speed, direction, etc.) and location information for all the on-line trains, and all the trackside object resource information reported by the OCs, and can derive the zone in which a train may be located according to kinematic equations when the train is determined as a location-uncertain train. Other factors, for example a safety profile and a braking distance upon emergency braking, may be taken into consideration when making the derivation.

In an embodiment, the TMC may calculate the zone in which the location-uncertain train is located based on a possible running status of the location-uncertain train and the second train operation information the location-uncertain train reported last time, wherein the running status may include continued running or emergency braking.

A location-uncertain train has a possible zone varies with its running status. Therefore the zone in which a location-uncertain train may be located may be calculated depending on its running status.

In an embodiment, if the possible running status for a location-uncertain train is continued running, the TMC may determine a forward farthest distance $s_{forward}$ of the location-uncertain train from a train location in the second train operation information $d_{location}$ reported last time, based on a maximum speed limit of the train $v_{maxspeed}$, a maximum traction acceleration of the train $a_{maxtraction}$, a train speed in the second train operation information reported last time $v_0$, and a time difference from reporting the second train operation information last time $t_{total}$, determine a reverse farthest distance $s_{reverse}$ of the location-uncertain train, based on $v_{maxspeed}$, an emergency braking acceleration of the train $a_{emergency}$, $v_0$ and $t_{total}$, and determine the zone in which the location-uncertain train is located based on $d_{location}$, $s_{forward}$, and $s_{reverse}$.

Figure 3:
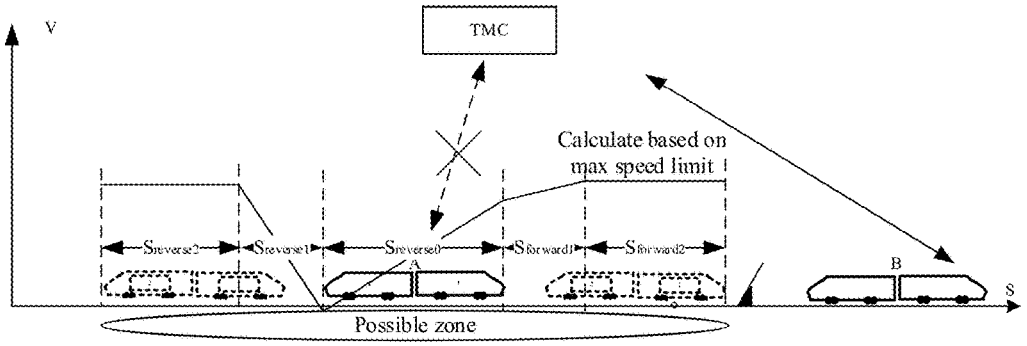
FIG. 3 is a schematic showing a location-uncertain train when the location-uncertain train goes forward with a continued running or backward with an emergency braking, according to an embodiment of the disclosure.

FIG. 3 is a schematic showing a location-uncertain train when the location-uncertain train goes forward with a continued running or backward with an emergency braking, according to an embodiment of the disclosure. In the drawing, the speed variation of the train is shown on the vertical axis, and the location of the train is shown on the horizontal axis. The train B in the drawing is the train immediately preceding to the location-uncertain train. As shown in FIG. 3, in case of forward continued running, $s_{forward}$ may be obtained by the following equations:

$$\begin{cases} t_1 = (v_{maxspeed} - v_0)/a_{maxtraction} \\ s_{forward1} = v_0 t_1 + \frac{1}{2} a_{maxtraction} t_1^2 \\ s_{forward2} = v_{maxspeed}(t_{total} - t_1) \end{cases}$$

Where $t_1$ indicates the period the location-uncertain train takes to accelerate from $v_0$ to $v_{maxspeed}$, $s_{forward1}$ is the distance the location-uncertain train travels within the period $t_1$, and $s_{forward2}$ is the distance the location-uncertain train travels after it has accelerated to $v_{maxspeed}$.

Therefore, $s_{forward}=s_{forward1}+s_{forward2}$, $$s_{forward}=v_{maxspeed}t_{total}-(v_{maxspeed}-v_0)^2/2a_{maxtraction}.$$

It is possible that the train may change its direction to run in the reverse direction. Taking into consideration the safety requirement for the train's reverse running after emergency braking, $s_{reverse}$ may be obtained by the following equations.

$$\begin{cases} s_{reverse0} = v_0^2/2a_{emergency} \\ s_{reverse1} = v_{maxspeed}^0/2a_{maxtraction} \\ s_{reverse2} = v_{maxspeed}(t_{total} - v_{maxspeed}/a_{maxtraction} - v_0/a_{emergency}) \end{cases}$$

Where $s_{reverse0}$ is the distance the location-uncertain train travels after the emergency braking, $s_{reverse1}$ is the distance the location-uncertain train travels from its reverse running to the time its speed has reached $v_{maxspeed}$, and $s_{reverse2}$ is the distance the location-uncertain train travels after its speed of reverse running has reached $v_{maxspeed}$.

Therefore $s_{reverse}=s_{reverse0}-s_{reverse1}-s_{reverse2}$, and $$s_{reverse}=-v_{maxspeed}t_{total}+v_{maxspeed}^2/2a_{maxtraction}+v_0^2/2a_{emergency}+v_0v_{maxspeed}/a_{emergency}.$$

After calculating $s_{forward}$ and $s_{reverse}$, the zone in which the location-uncertain train may be located (the possible zone in FIG. 3) can be obtained based on $d_{location}$, $s_{forward}$ and $s_{reverse}$ as:

$$[d_{location}-s_{reverse}-d_{safe}, d_{location}+s_{forward}+d_{safe}],$$

where $d_{safe}$ is a predetermined safe distance between trains.

The "forward" and "reverse" as used in the embodiment are used with reference to the operation direction in the second train operation information that the location-uncertain train reported last time. The forward direction is the direction same as the operation direction, and the reverse direction is the direction opposed to the operation direction. The above range $[d_{location}-s_{reverse}-d_{safe}, d_{location}+s_{forward}+d_{safe}]$ indicates that if the location-uncertain train makes continued running, its location from a train location in the second train operation information reported last time is at the farthest $s_{reverse}+d_{safe}$ in the reverse direction, and at the farthest $s_{forward}+d_{safe}$ in the forward direction.

Figure 4:
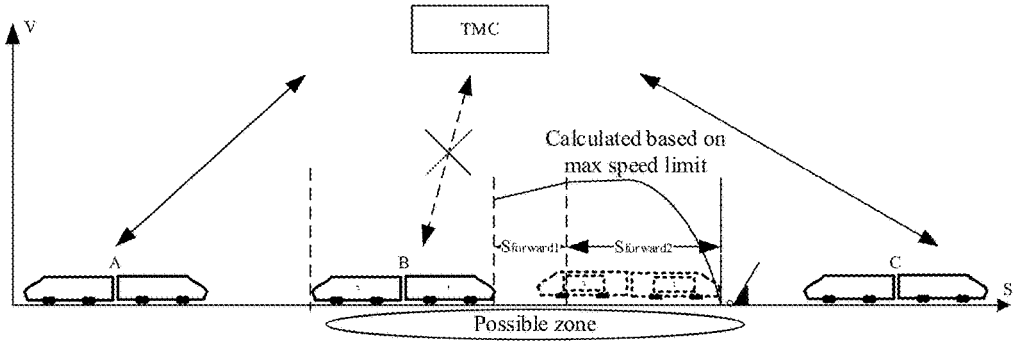
FIG. 4 is a schematic showing a location-uncertain train when emergency braking according to an embodiment of the disclosure.

FIG. 4 is a schematic showing a location-uncertain train when its running status is emergency braking according to an embodiment of the disclosure. Train A and train C in the drawing are the trains immediately preceding and the immediately succeeding the location-uncertain train respectively. In this case, the zone in which the location-uncertain train is located (the possible zone in FIG. 4) may be determined as:

$$[d_{location}-d_{maxrecede}-d_{safe}, d_{location}+s_{forwardtravel}+d_{safe}]$$

Where $d_{location}$ is the train location in the second train operation information that the location-uncertain train reported last time, $d_{maxrecede}$ is a predetermined tolerable maximum receding distance, $d_{safe}$ is a predetermined safe distance between trains, $s_{forwardtravel}$ is the sum of a distance the train travels during a predetermined period for communication fault determination and a distance the train travels after the emergency braking.

For emergency braking applied by a location-uncertain train, the train may possibly accelerate during the period for communication fault determination, and apply the emergency braking after the communication fault determination, and the traveling distances in the two part may be taken into consideration:

$$\begin{cases} v_1 = v_0 + a_{maxtraction} t_0 \\ s_{forward1} = v_0 t_0 + \frac{1}{2} a_{maxtraction} t_0^2 \\ s_{forward2} = \frac{v_1^2}{a_3} \alpha v_1 + \beta \end{cases}$$

and $$s_{forward}=s_{forward1}+s_{forward2}.$$

Therefore, $s_{forwardtravel}=v_0t_1+(1/2)a_{maxtraction}t_1^2+(v_0+a_{maxtraction}t_1)^2/a_3+\alpha(v_0+a_{maxtraction}t_1)+\beta$.

Where $v_0$ is a train speed in the second train operation information that the location-uncertain train reported last time, $t_0$ is the period for communication fault determination, $v_1$ is the speed that the train has accelerated to before the communication fault is determined, $a_{maxtraction}$ is a maximum traction acceleration of the train, $a_3$ is the sum of the emergency braking acceleration of the train and a slope-produced acceleration, $\alpha$ is a predetermined first coefficient, and $\beta$ is a predetermined second coefficient. In practice the period for communication fault determination can be configured depending on the application scenarios, for example configured to 1 second.

In an embodiment, if the following train is a faulty train whose running status is emergency braking, the virtual coupling operation instruction the ITS system dispatches to the IVOC of the head train may further include an exit path for virtual coupling operating train. The IVOC may operate according to the exit path after a successful virtual coupling of a train as the head train and a corresponding following train.

When a train is designated as a head train, the IVOC of the head train leads the faulty train to run according to the exit path in the virtual coupling operation instruction so that the faulty train will go back to station or move to a turnout to achieve a timely transfer of the faulty train.

In an embodiment, the ITS system may further send the exit path to the TMC, and the TMC may add the exit path to the zone in which the corresponding faulty train is located and send the zone after the addition to the ITS system and the IVOCs of the trains that are not faulty.

In the embodiment, the TMC may send to the ITS system the location information for all the trains (valid second train operation information) and the zone in which a location-uncertain train is located, so that the ITS system may dynamically display the locations or zones for the trains on an electronic map in real time. After the ITS system determines a faulty train, or further dispatches the exit path, the TMC may further send the zone in which the faulty train is located, or the zone in which the faulty train is located and on which the exit path is combined, to the IVOCs of the non-faulty trains. A train may select a path on which no faulty train exists to travel if it determines that the faulty train is on the expected path. A train may also operate at a low speed and in the active recognition mode if it determines that it is currently in or near the zone in which the faulty train is located.

In the embodiment, the faulty train whose running status is emergency braking is in the zone of $[d_{location}-d_{maxrecede}-d_{safe}, d_{location}+s_{forwardtravel}+d_{safe}]$. We denote $d_{location}-d_{maxrecede}-d_{safe}$ as $s_{location1}$, and $d_{location}+s_{forwardtravel}+d_{safe}$ as $s_{location2}$, and TMC may add the exit path to the zone for the faulty train, resulting in a zone of $[\min(s_{location1}, d_{exitpathending}), \max(s_{location2}, d_{exitpathending})]$.

Where $d_{exitpathending}$ is a distance between the ending of the exit path and the location of train in the second train operation information reported last time. In other words, the distance of the location-uncertain train from the location of train in the second train operation information reported last time, at the farthest, is the minimum of $s_{location1}$ and $d_{exitpathending}$ in the reverse direction, and is the maximum of $s_{location2}$ and $d_{exitpathending}$ in the forward direction.

In an embodiment, when the zone in which the location-uncertain train is located includes a railroad crossing, the TMC may re-calculate the zone in which the location-uncertain train is located according to both statuses of the railroad crossing, and combine the zones calculated for the statuses as the zone in which the location-uncertain train is located. The statuses of the railroad crossing include forward and reverse.

In practical operation, there are railroad crossings on the lines. A train will travel in different paths when a railroad crossing is in different statuses. After calculating for the first time the zone in which the location-uncertain train is located based on the possible running status of the location-uncertain train and the second train operation information reported last time, if there is any railroad crossing in the calculated zone, it is possible to calculate a zone for each of the statuses of the railroad crossing, and combine the zones for both statuses to use the combined zone as the zone in which the location-uncertain train is located. In this way it is possible to ensure that the obtained zone for the location-uncertain train include all the possible zones for the train. The calculation of the zones for the statuses may be made in the same way as the first calculation.

The zone the TMC calculates in the above manner is a possible zone for the location-uncertain train and may be inaccurate but contain errors. In order to improve the accuracy of positioning a location-uncertain train, the TMC may correct the above zone based on various location correction information after preliminarily calculating the zone for the location-uncertain train.

In an embodiment, the TMC may correct the zone in which the location-uncertain train is located based on at least one of location correction information and send to the ITS system the corrected zone in which the location-uncertain train is located. The location correction information may include: location information for the train immediately preceding the location-uncertain train, location information for the train immediately succeeding the location-uncertain train, location information for other trains that are on-line, trackside equipment status information reported by the OC, and line termination of the operation lines.

TMC can obtain the operation information for all the trains. Therefore, if a location-uncertain train and another train has a relation of coupling to the front or to the rear, it is possible to correct the zone for the location-uncertain train by using the location information of the preceding and/or succeeding train of the location-uncertain train. The zone for the location-uncertain train cannot exceed the location of its preceding train in the forward direction and cannot exceed the location of its succeeding train in the reverse direction. Likewise, the zone for the location-uncertain train cannot skip another communicated train. Therefore the TMC may correct the boundaries of the zone in which the location-uncertain train is located based on the location of a communicated train. When the zone overlaps the location of the communicated train, the boundary of the zone for the location-uncertain train may be corrected to recede a safety distance from the location of the communication train. The safety distance may be an active recognition distance for the active recognition unit, or a predetermined distance.

Since the zone in which the location-uncertain train cannot exceed the line termination, the TMC can correct the zone in which the location-uncertain train is located based on information of line termination.

Trackside objects are track equipment and segments on the operation lines for trains, and their locations are fixed on the lines. Therefore, the trackside object status information that trackside objects report to the OC is accurate, and the calculated zone that covers a relatively large range may be corrected based on the trackside object status information to improve the positioning accuracy of the zone. For example, trackside equipment may be axle counters and/or railroad crossings. When a train is passing by, an axle counter may report to the OC and hence the zone may be corrected based on the train operation information reported by all the axle counters within the zone. If the railroad crossing in front of the location of train in the valid first location information that a location-uncertain train reports for the first time has a status of four-throw, the zone can be determined to be in front of the railroad crossing.

In an embodiment, the TMC may correct the zone in which the following train is located, based on a front train recognition result from an active recognition unit of an on-line train other than the following train.

When the IVOC of a train includes an active recognition result, if another train can recognize the location-uncertain train and its number (which may be on an LED display or printed on the train body) based on its active recognition unit, the TMC can correct the zone in which the following train is located based on the active recognition information from another train.

In an embodiment, the TMC may obtain a train entrance information reported to the OC by an axle counter for main line entrance, determine the zone in which the entering train is located according to the location of the axle counter for main line entrance that reports the train entrance information, and send to the ITS system the zone in which the entering train is located. The ITS system may determine an unscheduled train that has entered the main line for operation, based on the operation plan for the trains and the zone in which the entering train is located sent by the TMC, and determine the unscheduled train as a faulty train.

When a train enters the main line for operation, the axle counter for the main line entrance may notify the corresponding OC of the train's entrance, and the OC may send the train entrance information and the location of the axle counter for the main line to the TMC. The TMC may determine the zone in which the entering train may be located based on the information sent by the OC, and send the zone to the ITS system. The ITS system can then determine the unscheduled train (the train that is not in the operation plan) among entering trains based on the operation plan.

In the embodiment, the zone in which the entering train is located is:

$$[d_{entrance}, d_{entrance}+v_{RMspeedlimit}t+d_{safe}],$$

Where $d_{entrance}$ is the location of the axle counter for main line entrance that reports the train entrance, $v_{RMspeedlimit}$ is the maximum speed limit of the train under a restricted manual-drive (RM) mode, t is the period so far from the entering train pressed on the axle counter for main line entrance, and $d_{safe}$ is a predetermined safe distance between trains.

In an embodiment, when there is more than one location-uncertain trains on a same operation line, if the zones in which adjacent location-uncertain trains are located overlap, or if a distance between the zones in which adjacent location-uncertain trains are located is less than a predetermined distance, the TMC may combine the zones in which the adjacent location-uncertain trains are located, use the combined zone as a zone in which the adjacent location-uncertain trains are located, and send the adjacent location-uncertain trains and the combined zone to the ITS system.

If there are a plurality of location-uncertain trains on a line and a plurality of separate zones, the zones for the location-uncertain trains may in some cases be combined to indicate to scheduling staff that a plurality of location-uncertain trains are on the corresponding line and there is a possibility of collision in the zone. Upon receiving the adjacent location-uncertain trains and the combined zone sent from the TMC, if it is determined that the location-uncertain trains include a faulty train, the ITS system may warn the scheduling staff and block the combined zone, in addition to specify a head train for rescue.

In an embodiment, when a train is determined as a faulty train and then the first train operation information or the second train operation information is received indicating that the faulty train is in a normal operation status, the ITS system may cancel the determination of the train as the faulty train and the corresponding virtual coupling operation instruction.

Faulty trains as determined are not necessarily fault, and report of operation information may be abnormal due to a temporary communication fault or other reasons. The ITS system may cancel a preliminary determination that a train is faulty and the corresponding virtual coupling operation instruction, based on the first train operation information or the second train operation information that is received in real time and that indicates a normal operation status.

In practice, different colors and marks may be used to distinguish between different kinds of trains (normal, faulty, location-uncertain, etc.), and the zone in which a plurality of location-uncertain trains may be located may be highlighted to prompt the scheduling staff the possibility of train collision. The TMC may send the zone in which a location-uncertain train (and faulty train) is located to other trains running on-line, so that the trains may each select a path on which no faulty train exists to travel if it determines that the faulty train is on the expected path, or operate at a low speed and in the active recognition mode if it determines that it is currently in or near the zone in which the faulty train is located.

The ITS system may send the information of canceling the faulty train determination to the TMC. When the faulty train travels to a specified spot in accordance with the exit path dispatched by the ITS system to exit operation, the driver could report to the scheduling staff and the scheduling staff may send confirmation information to the TMC. If the TMC receives the information of canceling the faulty train determination, or receives the confirmation information from the scheduling staff, or receives information indicating a normal train operation status for a train after the train is determined as location-uncertain, the TMC may automatically delete the zones in which the train corresponding to such information is located, i.e. inform the other trains that the zone has become normal and the restriction for the zone is canceled. Therefore the restriction on the other trains for the zone may be timely canceled and operation efficiency may be improved.

Figure 5:
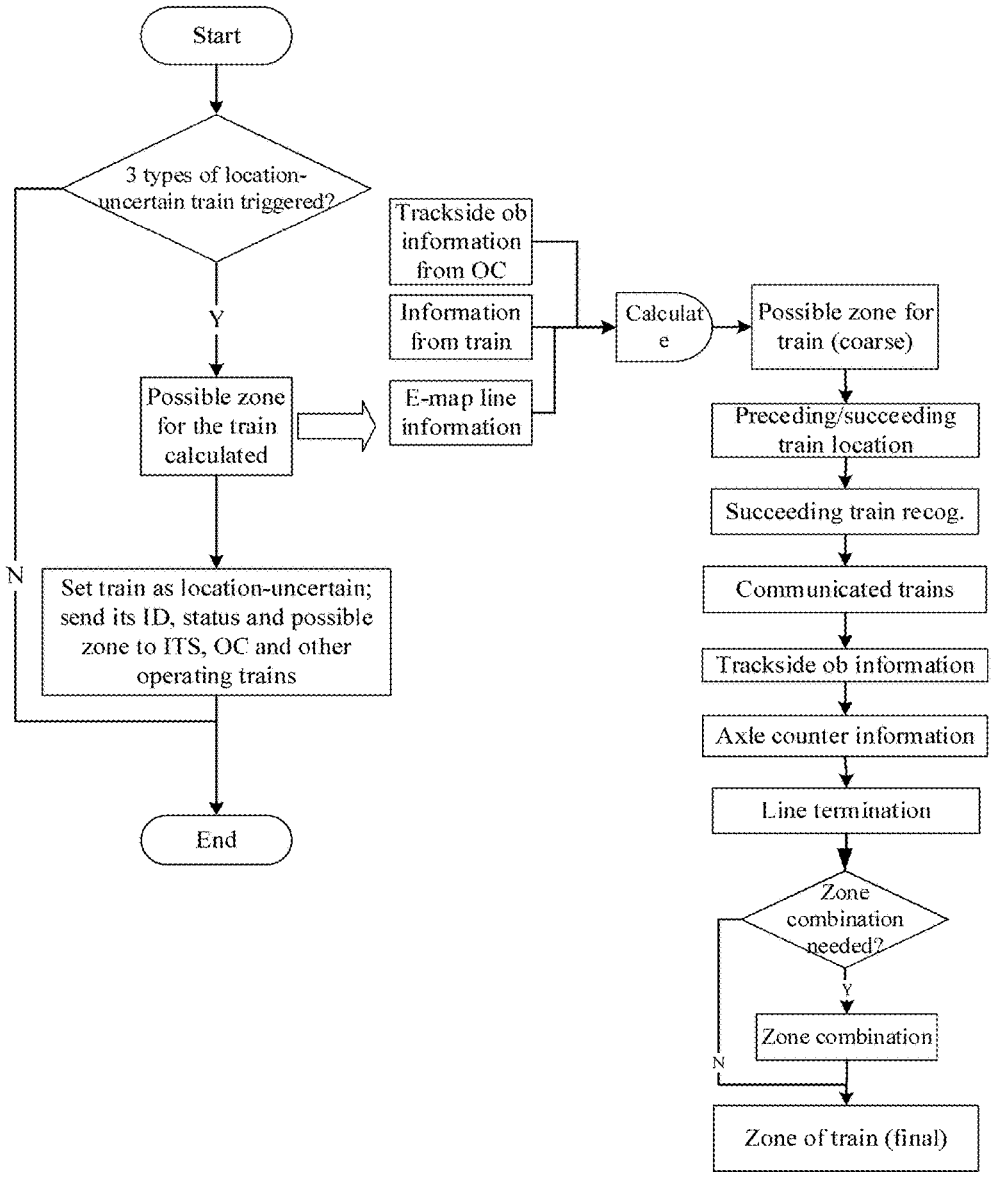
FIG. 5 is a flowchart showing the TMC determines a location-uncertain train, calculates the zone in which the location-uncertain train is located, and performs correction and combination to the zone according to an embodiment of the disclosure.

FIG. 5 is a flowchart showing the TMC determines a location-uncertain train, preliminarily calculates the zone in which the location-uncertain train is located, and performs correction and combination to the preliminarily calculated zone according to an embodiment of the disclosure. As is shown, in the embodiment, after determining a location-uncertain train based on the situations of the three types of location-uncertain trains, the TMC may correct the zone in which the location-uncertain train is located based on locations of the trains preceding and/or succeeding the location-uncertain train, active recognition information of the succeeding train, locations of other communicated trains, trackside object information obtained by communication with OCs, axle counter information, and line termination, among others. That is, the zone is screened according to the various correction information to obtain a corrected zone. The TMC may further determine if a zone combination is to be made based on the information on the corrected zones for all the location-uncertain trains, to obtain a final zone in which the location-uncertain trains are located.

The train control system as provided herein can reduce ground equipment and trackside equipment (including ZC, CI, signal machine, track circuit, active responder, etc.) yet still providing the functions of conventional subway systems. A train may calculate a movement authority autonomously based on an operation plan, situation of line resources and its own operation status, to ensure an autonomous safety control of the train on the line. With front and rear safety distances to a train, two adjacent moving block zones may proceed simultaneously at a small separation, so that the trains may operate at allowed maximum speed and small interval and operation efficiency may be improved. When a train cannot report a valid location of its own, the TMC may calculate the possible zone for the train and prompt the scheduling staff, and other trains may change the path to bypass the location-uncertain train. When a faulty train is on the main line, the ITS system may specify a nearby train for rescue, and in case the faulty train does not have a fault in its traction and brake system, it is possible to perform a virtual coupling through vehicle-vehicle communications or in an active recognition manner to lead the faulty train out of the faulty segment. The system can have lower costs in construction and maintenance, reduced intermediaries, improved performance, less complexity, higher reliability and shortened operation interval.

It will be appreciated that the disclosure is not limited to the exact construction that has been described above and illustrated in the accompanying drawings, and that various modifications and changes can be made without departing from the scope thereof. It is intended that the scope of the disclosure only be limited by the appended claims and their equivalents.

What is claimed is:

1. An urban rail transit (URT) train control system based on vehicle-vehicle communications, comprising an intelligent train supervision (ITS) system, a train manage center (TMC), a data communication system (DCS), and an intelligent vehicle on-board controller (IVOC) provided on each of trains, the ITS system, the TMC and the IVOC being communicatively coupled by the DCS, and IVOCs of the trains being communicatively coupled by the DCS, wherein the ITS system is configured to: supervise the trains that are on-line, dispatch an operation plan to the IVOCs, receive first train operation information reported by the trains in accordance with a predetermined period and second train operation information sent by the TMC in accordance with the predetermined period, determine a following train for which a virtual coupling operation is needed and a head train corresponding to the following train, and dispatch a virtual coupling operation instruction to the IVOC of the head train;

wherein the virtual coupling operation means that the following train runs following the head train, the following train includes a faulty train and a train that meets a preset condition of virtual coupling operation, each of the first train operation information and the second train operation information comprises numbers, locations, and operation statuses of the trains, and the virtual coupling operation instruction comprises a zone in which the following train is located;

wherein the TMC is configured to receive the second train operation information reported by the trains that are on-line in accordance with the predetermined period, and to send the second train operation information to the ITS system; and wherein the IVOC is configured to: perform information interaction with the ITS system, the TMC, and the IVOCs of the others among the trains, report the first train operation information to the ITS system in accordance with the predetermined period, report the second train operation information to the TMC, and control, when a train is determined as the head train, the train to go to the zone in which the following train in the virtual coupling operation instruction is located, and establish communication with the IVOC of the following train to complete a virtual coupling for the virtual coupling operation.

2. The train control system of claim 1, wherein the system further comprises an object controller (OC), the OC and the ITS system being communicatively coupled by the DCS, and the OC and the IVOC being communicatively coupled by the DCS, wherein the IVOC is further configured to send, after the virtual coupling is completed between the head train and the vehicle train, virtual coupling complete information and newly marshalled train information to the ITS system, wherein the newly marshalled train information comprises the number of the head train, the number of the following train, and the length of the marshalled train;

wherein the ITS system is further configured to send to the OC, after receiving the virtual coupling complete information and newly marshalled train information, an object resource release instruction for the following train in the newly marshalled train information to cancel the number of the following train in the newly marshalled train information, wherein the object resource comprises a trackside equipment resource and a segment resource; and wherein the OC is configured to release the object resource occupied by the corresponding following train according to the received object resource release instruction.

3. The train control system of claim 1, wherein the ITS system is configured to determine, when the first train operation information or the second train operation information indicates existence of a train in a faulty operation status, the train in the faulty operation status as a faulty train; and wherein the ITS system is further configured to determine the zone in which the faulty train is located based on the first train operation information or the second train operation information.

4. The train control system of claim 1, wherein the ITS system is configured to determine, when operation information of a train exists in neither of the first train operation information and the second train operation information, the train corresponding to the operation information as a faulty train; and wherein the ITS system is further configured to determine the zone in which the faulty train is located based on the first train operation information reported by the faulty train last time and the second train operation information.

5. The train control system of claim 1, wherein the IVOC is further configured to report, each time a train leaves a station, the number and the time of leave of the train to the ITS system; and wherein the ITS system is further configured to receive the number and the time of leave of the train reported each time the train leaves a station, and to determine, if the number and the time of leave are not received from the train at a next station within a set period from the time of report at a current station, that the train, for which the number and the time of leave are not received at the next station, is located between the current station and the next station.

6. The train control system of claim 2, wherein the IVOC is further configured to establish communication with the OC corresponding to a station region each time a train travels to the station region; and the OC is further configured to report to the ITS system, when establishing communication with the train entering the station region is failed, that a faulty train is in the station region.

7. The train control system of claim 1, wherein the TMC is further configured to identify a location-uncertain train based on the received second train operation information, to calculate the zone in which the location-uncertain train is located based on the second train operation information that the location-uncertain train reported last time, and to send to the ITS system the zone in which the location-uncertain train is located, wherein the location-uncertain train includes a train the second train operation information currently reported by which is abnormal; and the ITS system is further configured to determine a fault train among location-uncertain trains based on the zone in which the locations uncertain trains are located and on the first train operation information.

8. The train control system of claim 7, wherein the train the second train operation information currently reported by which is abnormal includes:

the train for which no reported second train operation information is received within a set period not shorter than the predetermined period;

the train for which a jump occurs in its train speed;

the train for which the reported current location information is the same as the location information reported last time; or the train that loses location degradation.

9. The train control system of claim 7, wherein the ITS system is configured to determine, when no first train operation information for the location-uncertain train is received, the location-uncertain train as a fault train.

10. The train control system of claim 7, wherein the TMC is configured to calculate the zone in which the location-uncertain train is located based on a possible running status of the location-uncertain train and the second train operation information the location-uncertain train reported last time, wherein the running status comprises continued running or emergency braking.

11. The train control system of claim 10, wherein if the running status is continued running, the TMC is configured to:

determine a forward farthest distance $s_{forward}$ of the location-uncertain train from a train location in the second train operation information $d_{location}$ reported last time, based on a maximum speed limit of the train $v_{maxspeed}$, a maximum traction acceleration of the train $a_{maxtraction}$, a train speed in the second train operation information reported last time $v_0$, and a time difference from reporting the second train operation information last time $t_{total}$, determine a reverse farthest distance $s_{reverse}$ of the location-uncertain train, based on $v_{maxspeed}$, an emergency braking acceleration of the train $a_{emergency}$, $v_0$ and $t_{total}$, and determine the zone in which the location-uncertain train is located based on $d_{location}$, $s_{forward}$, and $s_{reverse}$.

12. The train control system of claim 11, wherein the zone in which the location-uncertain train is located is determined based on $d_{location}$, $s_{forward}$, and $s_{reverse}$ as:

$$[d_{location}-s_{reverse}-d_{safe}, d_{location}+s_{forward}+d_{safe}],$$

$$s_{forward}=v_{maxspeed}t_{total}-(v_{maxspeed}-v_0)^2/2a_{maxtraction},$$

and $$s_{reverse}=-v_{maxspeed}t_{total}+v_{maxspeed}^2/2a_{maxtraction}+v_0^2/2a_{emergency}+v_0v_{maxspeed}/a_{emergency},$$

where $d_{safe}$ is a predetermined safe distance between trains.

13. The train control system of claim 10, wherein if the running status is emergency braking, the zone is determined as:

$$[d_{location}-d_{maxrecede}-d_{safe}, d_{location}+s_{forwardtravel}+d_{safe}],$$

$$S_{forwardtravel}=v_0t_1+(1/2)a_{maxtraction}t_1^2+(v_0+a_{maxtraction}t_1)^2/a_3+\alpha(v_0+a_{maxtraction}t_1)+\beta,$$

where $d_{location}$ is the train location in the second train operation information that the location-uncertain train reported last time, $d_{maxrecede}$ is a predetermined tolerable maximum receding distance, $d_{safe}$ is a predetermined safe distance between trains, $s_{forwardtravel}$ is the sum of a distance the train travels during a predetermined period for communication fault determination and a distance the train travels after the emergency braking, $v_0$ is a train speed in the second train operation information that the location-uncertain train reported last time, $t_1$ is the period for communication fault determination, $a_{maxtraction}$ is a maximum traction acceleration of the train, $a_3$ is the sum of the emergency braking acceleration of the train and a slope-produced acceleration, $\alpha$ is a predetermined first coefficient, and $\beta$ is a predetermined second coefficient.

14. The train control system of claim 10, wherein if the following train is a train whose running status is emergency braking, the virtual coupling operation instruction further comprises an exit path for virtual coupling operating train; and the IVOC is further configured to operate according to the exit path after a successful virtual coupling of a train as the head train and a corresponding following train.

15. The train control system of claim 14, wherein the ITS system is further configured to send the exit path to the TMC; and the TMC is further configured to add the exit path to the zone in which the corresponding faulty train is located and send the zone after the addition to the ITS system and the IVOCs of the trains that are not faulty.

16. The train control system of claim 7, wherein the TMC is further configured to, when the zone in which the location-uncertain train is located includes a railroad crossing, re-calculate the zone in which the location-uncertain train is located according to both statuses of the railroad crossing, and combine the zones calculated for the statuses as the zone in which the location-uncertain train is located.

17. The train control system of claim 7, wherein the TMC is further configured to correct the zone in which the location-uncertain train is located based on at least one of location correction information and send to the ITS system the corrected zone in which the location-uncertain train is located; and wherein the location correction information comprises: location information for the train immediately preceding the location-uncertain train, location information for the train immediately succeeding the location-uncertain train, location information for other trains that are on-line, trackside equipment status information reported by the OC, and line termination of the operation lines.

18. The train control system of claim 2, wherein the TMC is further configured to obtain a train entrance information reported to the OC by an axle counter for main line entrance via communicative coupling between the DCS and the OC, obtain the zone in which the entering train is located according to the location of the axle counter for main line entrance that reports the train entrance information, and send to the ITS system the zone in which the entering train is located; and the ITS system is further configured to determine an unscheduled train that has entered the main line for operation, based on the operation plan for the trains and the zone in which the entering train is located sent by the TMC, and determine the unscheduled train as a faulty train.

19. The train control system of claim 18, wherein the zone in which the entering train is located is:

$$[d_{entrance}, d_{entrance}+v_{RMspeedlimit}t+d_{safe}],$$

where $d_{entrance}$ is the location of the axle counter for main line entrance that reports the train entrance, $v_{RMspeedlimit}$ is the maximum speed limit of the train under a restricted manual-drive (RM) mode, t is the period so far from the entering train pressed on the axle counter for main line entrance, and $d_{safe}$ is a predetermined safe distance between trains.

20. The train control system of claim 1, wherein the IVOC further comprises an active recognition unit configured to:

obtain an image in front of the train, and recognize a front train according to the obtained image, wherein if the train is determined as the head train and unable to establish communication with the IVOC of the corresponding following train through the DCS system, then after the train arrives at the zone in which the corresponding following train is located and the following train is recognized, the active recognition unit is configured to establish communication with the active recognition unit of the recognized following train based on a preconfigured communication manner to complete the virtual coupling.

* * * * *